US008414262B2

(12) United States Patent
Hada

(10) Patent No.: US 8,414,262 B2
(45) Date of Patent: Apr. 9, 2013

(54) TURBINE BLADE HAVING SQUEALER

(75) Inventor: Satoshi Hada, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 428 days.

(21) Appl. No.: 12/608,438

(22) Filed: Oct. 29, 2009

(65) Prior Publication Data

US 2010/0111704 A1 May 6, 2010

Related U.S. Application Data

(60) Provisional application No. 61/109,732, filed on Oct. 30, 2008.

(51) Int. Cl.
*F01D 5/20* (2006.01)

(52) U.S. Cl. ..... 416/92; 416/224

(58) Field of Classification Search ..... 416/228, 416/92, 224; 415/173.1, 173.4
See application file for complete search history.

(56) References Cited

U.S. PATENT DOCUMENTS

| | | | | |
|---|---|---|---|---|
| 3,635,585 | A | 1/1972 | Metzler, Jr. | |
| 4,540,339 | A * | 9/1985 | Horvath | 416/92 |
| 4,589,823 | A * | 5/1986 | Koffel | 416/92 |
| 4,802,828 | A | 2/1989 | Rutz et al. | |
| 5,980,209 | A | 11/1999 | Barry et al. | |
| 6,059,530 | A * | 5/2000 | Lee | 416/97 R |
| 6,224,337 | B1 * | 5/2001 | Lieland et al. | 415/173.4 |
| 6,994,514 | B2 | 2/2006 | Soechting et al. | |
| 7,063,250 | B2 * | 6/2006 | Ohara et al. | 228/245 |
| 2004/0096328 | A1 | 5/2004 | Soechting et al. | |
| 2008/0044289 | A1 * | 2/2008 | Klasing et al. | 416/235 |

FOREIGN PATENT DOCUMENTS

| | | | |
|---|---|---|---|
| GB | 2378733 | A | 2/2003 |
| JP | 07-293202 | A | 11/1995 |
| JP | 3035187 | B2 | 4/2000 |
| JP | 2001-107702 | A | 4/2001 |
| JP | 2002-105666 | A | 4/2002 |
| JP | 2004-169694 | A | 6/2004 |
| JP | 2008-051094 | A | 3/2008 |

OTHER PUBLICATIONS

Written Opinion of the International Searching Authority dated Jul. 21, 2009 issued on the related PCT/JP2009/058922.
International Search Report of PCT/JP2009/058922, date of mailing Jul. 21, 2009.
Japanese Office Action dated Jan. 17, 2012, issued in corresponding Japanese Patent Application No. 2010-535699.

* cited by examiner

*Primary Examiner* — Richard Edgar
(74) *Attorney, Agent, or Firm* — Westerman, Hattori, Daniels & Adrian, LLP

(57) ABSTRACT

A turbine blade of the invention includes an air foil including a plurality of cooling flow passages through which a cooling medium flows from a leading edge region to a trailing edge region, a top plate which forms the apex of the air foil, has a heat-resistant coating applied on the upper surface thereof, and includes a plurality of cooling holes, and a squealer which protrudes radially outward from the blade from the top plate, and is formed so as to extend from a leading edge end to a starting end of the trailing edge region along a suction-surface-side blade wall in a peripheral direction of the blade.

8 Claims, 5 Drawing Sheets

TURBINE BLADE HAVING SQUEALER

TECHNICAL FIELD

The present invention relates to a turbine blade having a squealer at a blade tip thereof.

BACKGROUND ART

A gas turbine is constituted by a compressor, a combustor, and a turbine. The air taken in from an air inlet is compressed by the compressor, and is supplied to the combustor as a high-temperature and, high-pressure compressed air. In the combustor the compressed air and fuel are mixed and combusted, and the result is supplied to the turbine as a high-temperature and high-pressure combustion gas. In the turbine, a plurality of stator vanes and turbine blades are alternately disposed within a casing, the turbine blades are rotationally driven by the combustion gas supplied to an exhaust passage, and the rotational driving is recovered as electric power by a generator coupled with a rotor. The combustion gas which has driven the turbine is converted into hydrostatic pressure by a diffuser, and is emitted to the atmosphere.

In the gas turbine configured in this way, there is a possibility that the temperature of the combustion gas which acts on the plurality of stator vanes and turbine blades reaches 1500° C., and the stator vanes and the turbine blades are heated and damaged. Therefore, in the stator vanes and the turbine blades, a cooling flow passage is provided in an air foil, a blade wall is cooled by a cooling medium, such as cooling air received from the outside, and when the cooling medium is made to flow into the combustion gas from cooling holes provided in the blade wall, the surface of the blade is cooled by film cooling, etc.

Meanwhile, between a blade tip (apex) of each turbine blade which is rotationally driven, and a ring segment constituting the portion of the casing, a predetermined gap is provided so that both the blade tip and the ring segment do not interfere with each other. However, if the gap is too large, since a portion of the combustion gas flows over the blade tip and flows away to the downstream, energy loss occurs, which reduces the thermal efficiency of the gas turbine. In order to suppress the leak of the combustion gas from this gap, the blade tip of the turbine blade is provided with a squealer (also referred to as a thinning) which functions as damming, and the gap between the top surface of the squealer and the ring segment is made as small as possible to prevent a decrease in the thermal efficiency of the gas turbine.

An example of such a turbine blade is shown in FIGS. 5A and 5B.

A turbine blade 50 shown in FIG. 5A is erected on a platform 11 embedded in a rotating rotor disc (not shown) via a blade root portion 16, and a rotor (not shown) and the rotor disc (not shown) rotate integrally. When the section of the turbine blade 50 is seen from the radial direction of the blade, a pressurized-surface-side blade wall 18 is concavely formed from a leading edge to a trailing edge on the upstream of the blade in its rotational direction R, and a suction-surface-side blade wall 19 is convexly formed from the leading edge to the trailing edge end on the downstream of the blade in its rotational direction R. A blade tip 15 of the turbine blade 50 is blocked by a top plate 17. On the top plate 17, a squealer 23 is provided in the shape of a belt from the leading edge side to the trailing edge side along the suction-surface-side blade wall 19 in the peripheral direction of the turbine blade 50, and protrudes radially outward from the blade. In this configuration, a portion of a combustion gas FG which has come into contact with the blade surface from the turbine blade 50 on the side of the pressurized-surface-side blade wall 20 flows along the top plate 17 of the blade tip 15, flows over the squealer 23, and flows to a downstream exhaust passage.

As shown in FIG. 5B, in order to cool the top plate 17 and the squealer 23, the blade tip 15 of the turbine blade 50 is provided with cooling holes 28*a* and 28*b* through which a portion of the cooling medium CA which flows through the cooling flow passage 26 within the air foil 12 is blown off into the combustion gas. Additionally, although a portion of the combustion gas FG flows through the gap C between the ring segment 60 and the top surface 23*a* of the squealer 23, this gap flow causes the energy loss of the turbine, and causes a decrease in the thermal efficiency of the gas turbine. Accordingly, it is contrived to make the gap C as small as possible. Therefore, depending on the operating conditions of the gas turbine, the top surface 23*a* of the squealer 23 and the lower surface of the ring segment 60 rotate while being brought into contact with each other by the rotation of the turbine blade 50.

Additionally, in order to protect the blade surface directly exposed to the high-temperature combustion gas, a heat-resistant coating (also referred to as TBC) 24 is applied on outside surfaces, such as the top plate 17 of the blade tip 15, the suction-surface-side blade wall 19, the pressurized-surface-side blade wall 20, and a side wall 23*d* of the squealer, thereby interrupting the heat from the high-temperature combustion gas in order to prevent the damage of the blade surface. In this regard, as described above, since the gap C between the top surface 23*a* of the squealer 23 and the ring segment 60 is adjusted so as to be as small as possible, it is difficult to apply a heat-resistant coating on the top surface 23*a* of the squealer 23, and the base material of an air foil is exposed to the combustion gas. Therefore, the top surface 23*a* of the squealer is protected from the high-temperature combustion gas by the convection cooling of the cooling medium CA which flows through the cooling holes 28*b*.

Examples of turbine blades in which a squealer is provided at the whole periphery of a blade wall are disclosed in Patent Documents 1 to 3.

[Patent Document 1] Japanese Patent Unexamined Publication, First Publication No. 2004-169694

[Patent Document 2] Japanese Patent Unexamined Publication, First Publication No. 2001-107702

[Patent Document 3] Japanese Patent Unexamined Publication, First Publication No. 2008-051094

SUMMARY OF THE INVENTION

Problems that the Invention is to Solve

In recent years, in order to improve the thermal efficiency of a gas turbine, the temperature of a combustion gas tends to be higher, and the cooling of a turbine blade needs to be reinforced. Additionally, although the squealer disposed at the blade tip of the turbine blade described above is provided on the upper surface of the top plate from the leading-edge-side to the trailing edge side along the blade wall of the blade tip, since the width of the blade is narrow at the trailing edge side there is a possibility that the space in which cooling holes are provided is limited, and cooling becomes insufficient. Meanwhile, on the top surface 23*a* of the squealer, the surface of the base material of the air foil is exposed to the combustion gas. Thus, when the squealer is insufficiently cooled at the trailing edge side, there is a problem in that the squealer is damaged under the influence of the high-temperature combustion gas.

The object of the present invention is to provide a turbine blade having a squealer on tip which solves such a problem.

Means for Solving the Problem

In order to achieve the above object, a turbine blade of the invention includes a air foil including a plurality of cooling flow passages through which a cooling medium flows from a leading edge region to a trailing edge region, a top plate which forms the apex of the air foil and has a heat-resistant coating applied on the upper surface thereof, and which includes a plurality of cooling holes, and a squealer which protrudes radially outward from the blade from the top plate, and is formed so as to extend from a leading edge end to a starting end of the trailing edge region along a suction-surface-side blade wall in a peripheral direction of the blade.

In this case, since the squealer is formed from the leading edge end to the starting end of the trailing edge region along the suction-surface-side blade wall in the peripheral direction of the blade, and the squealer is not provided in the trailing edge region which is apt to be insufficiently cooled, the damage of the squealer is prevented. Additionally, in the trailing edge region in which the squealer is not provided, a heat-resistant coating is applied on the upper surface of the top plate to make the gap between it and the ring segment small, so that the loss of energy can be reduced and the damage by the combustion gas can also be prevented.

Additionally, a turbine blade of the invention includes an air foil including a plurality of cooling flow passages through which a cooling medium flows from a leading edge region to a trailing edge region, a top plate which forms the apex of the air foil and which has a heat-resistant coating applied on the upper surface thereof, and which includes a plurality of cooling holes, and a squealer which protrudes radially outward from the blade from the top plate, which is formed from a starting end of the trailing edge region along a suction-surface-side blade wall to a leading edge end in a peripheral direction of the blade, and is further formed so as to continuously extend from the leading edge end along a pressurized-surface-side blade wall to the starting end of the trailing edge region.

In this case, since the squealer is formed from the starting end of the trailing edge region along the suction-surface-side blade wall to the leading edge end in the peripheral direction of the blade, and is further formed so as to continuously extend from the leading edge end along the pressurized-surface-side blade wall to the starting end of the trailing edge region, and the squealer is not provided in the trailing edge region which is apt to be insufficiently cooled, the damage of the squealer is prevented. Additionally, in the trailing edge region in which the squealer is not provided, a heat-resistant coating is applied on the upper surface of the top plate to make the gap between it and the ring segment small, a gap flow leaking out of the blade tip becomes smaller, and the loss of energy is further reduced.

The height of the top plate may be set to be lower than the height of the top surface of the squealer by at least a predetermined value in consideration of variations in the finished height of the heat-resistant coating.

In this case, since the top plate is set to be lower than the top surface of the squealer by a predetermined value, even if the gap between the ring segment and the blade tip becomes small, the contact between the top plate and the ring segment can be prevented.

The height of the top plate of the leading edge region may be formed so as to be lower than the height of the top plate of the trailing edge region, and an inclined portion which has an upward gradient toward the trailing edge region from the leading edge region may be formed.

In this case, since the height of the top plate of the leading edge region is formed so as to be lower than the height of the top plate of the trailing edge region, the heavy contact between the ring segment and the top plate can be prevented, and the stable operation of the gas turbine is allowed.

The plurality of cooling holes may be arranged in a double line on the top surface of the squealer or the upper surface of the top plate in the leading edge region, and is arranged in a single line on the upper surface of the top plate in the trailing edge region.

In this case, since the double-line cooling holes are arranged in the top surface of the squealer or the upper surface of the top plate in the leading edge region, and the single-line cooling holes are arranged in the upper surface of the top plate in the trailing edge region, the insufficient cooling of the top plate and the squealer in the leading edge region and the trailing edge region are compensated for, and the damage of the top plate and the squealer can be prevented.

Advantage of the Invention

According to the present invention, since the damage of the squealer by a high-temperature combustion gas is prevented, and the loss of the combustion gas which flows over the turbine blade can be suppressed, a decrease in the thermal efficiency of a gas turbine can be prevented.

BEST MODE FOR CARRYING OUT THE INVENTION

Hereinafter, preferred embodiments of a turbine blade having a squealer according to the present invention will be described in detail with reference to the accompanying drawings. In addition, the present invention is not limited by these embodiments. Furthermore, constituent elements of these embodiments include elements which can be easily replaced by a person skilled in the art, or substantially the same elements.

Figure 1:
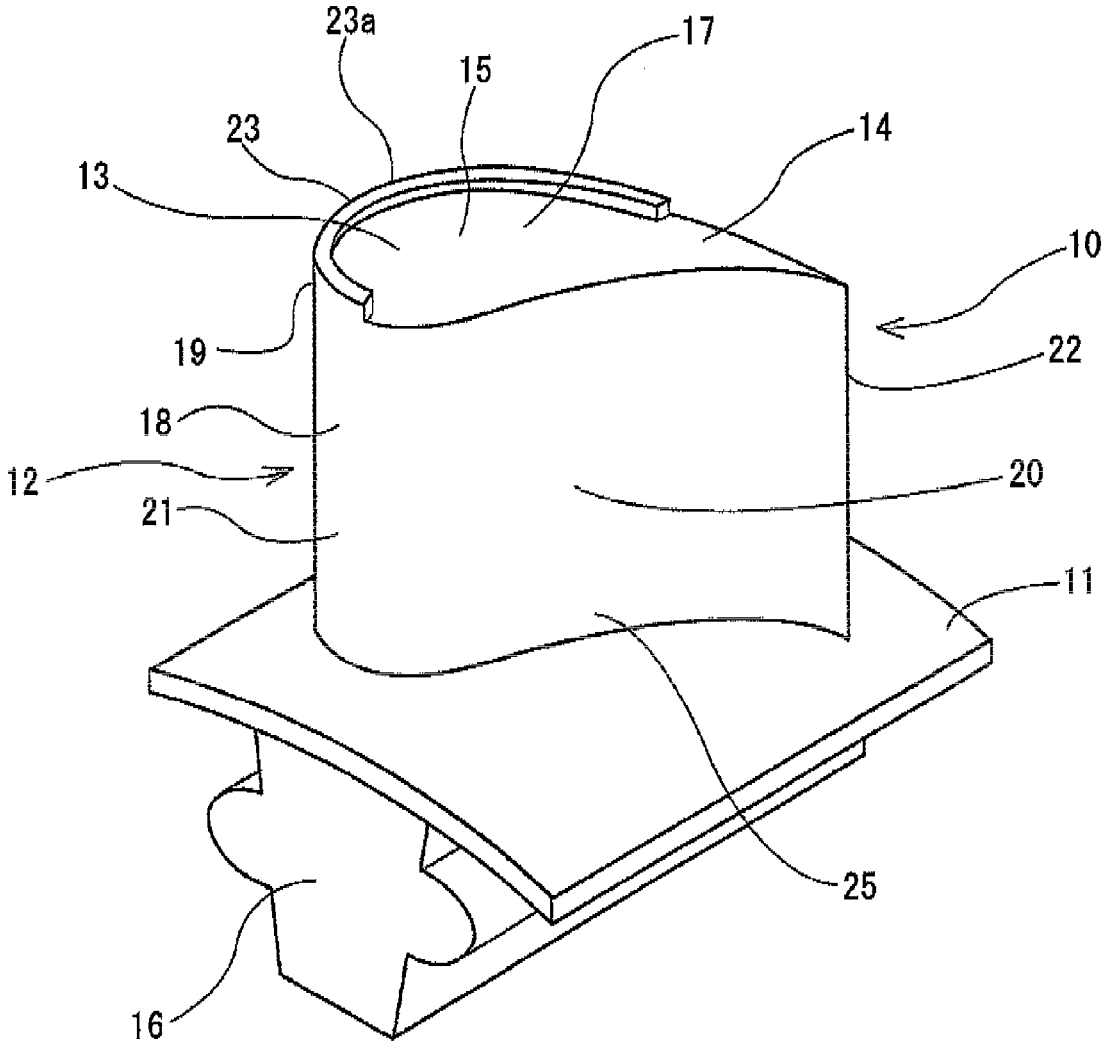
FIG. 1 shows a perspective view of a turbine blade according to a first embodiment.
Figure 2A:
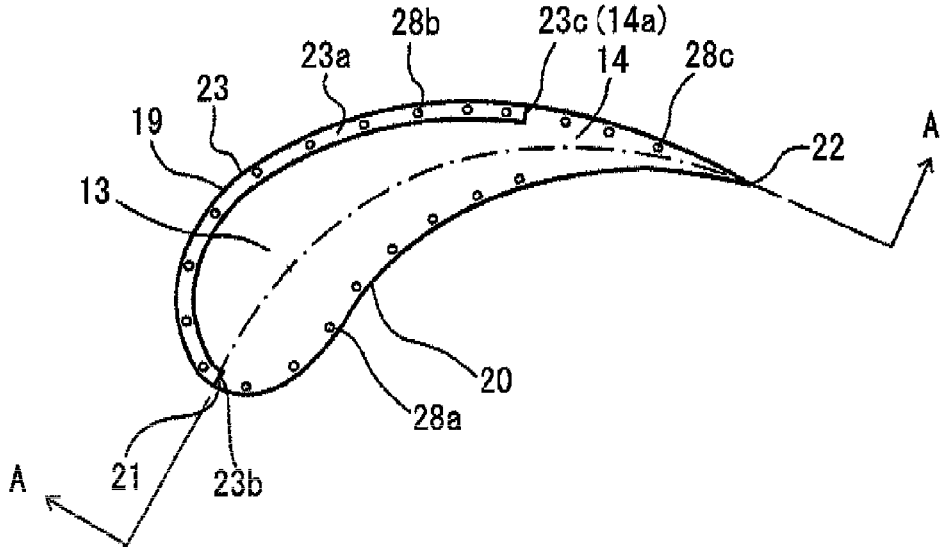
FIG. 2A shows a schematic plan view of a blade tip of the turbine blade according to the first embodiment.
Figure 2B:
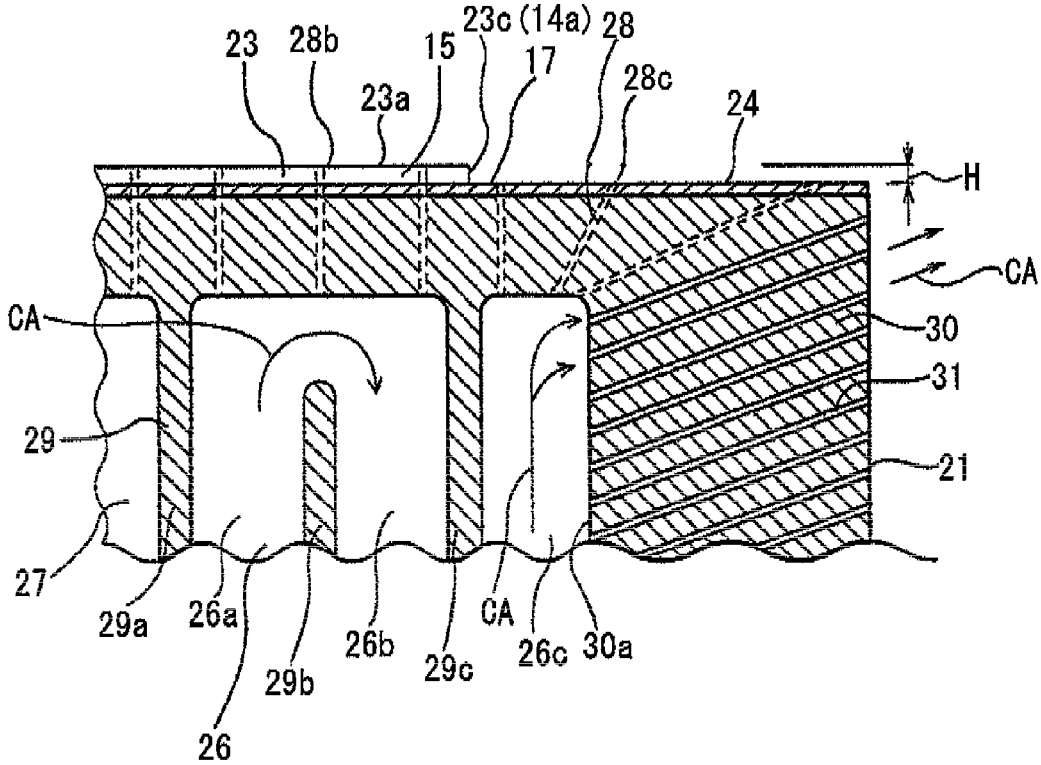
FIG. 2B shows a portion of a cross-section (section A-A of FIG. 2A) in an erected direction of the turbine blade shown in FIG. 2A.

FIG. 1 shows a perspective view of a turbine blade according to a first embodiment, FIG. 2A shows a schematic plan view of a blade tip of the turbine blade shown in FIG. 1, and FIG. 2B shows a portion of a cross-section (section A-A of FIG. 2A) in an erected direction of the turbine blade shown in FIG. 1. Common to individual constituent elements of a moving blade described in a conventional technique in terms of names or symbols will be described using the same names and symbols.

As shown in FIG. 1, the turbine blade 10 according to the first embodiment of the present invention is erected on a platform 11 embedded in a rotor disc (not shown) via a blade root portion 16, and a rotor (not shown) and the rotor disc rotate integrally. When the air foil 12 of the turbine blade 10 is seen from the radial direction of the rotor, a pressurized-surface-side blade wall 18 is concavely formed from a leading edge end 21 to a trailing edge end 22 on the upstream of the rotor in its rotational direction R, and a suction-surface-side blade wall 19 is convexly formed from the leading edge end 21 to the trailing edge end 22 on the downstream of the rotor in its rotational direction R. The width of the blade becomes smaller toward the trailing edge end 22. Additionally, in this embodiment, as for the shape of the air foil 12 when being seen from the radial direction of the rotor, a region in the vicinity of the leading edge end 21 is defined as a leading edge region 13, a region in the vicinity of the trailing edge end 22 is defined as a trailing edge region 14, and a region between the leading edge region 13 and the trailing edge region 14 is defined as an intermediate region. Also, the boundary between the trailing edge region 14 and the intermediate region is defined as a starting end 14*a* of the trailing edge region 14.

Figure 5A:
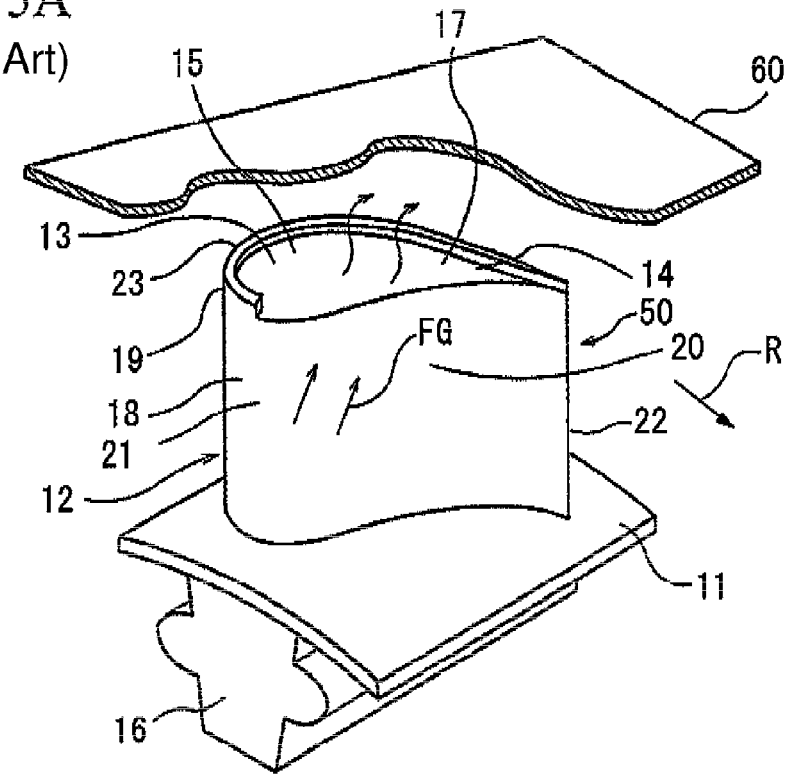
FIG. 5A (Prior Art)
FIG. 5A shows a perspective view of a turbine blade of a conventional technique.

The apex of the blade tip 15 of the air foil 12 is blocked by a top plate 17. A squealer 23, which extends radially outward from the rotor from the suction-surface-side blade wall 19, and extends from the leading edge end 21 to the starting end 14*a* of the trailing edge region 14 along the suction-surface-side blade wall 19 of the upper surface 17*t* of the top plate 17 in a peripheral direction of the air foil 12, is arranged on an upper surface 17*t* of the top plate 17. In addition, since the turbine blade 10 is exposed to a high-temperature combustion gas, similarly to the turbine blade of the conventional technique shown in FIGS. 5A and 5B, a cooling flow passage through which a cooling medium flows is provided inside the air foil 12, the cooling medium is received from the blade root portion 16, and the air foil is cooled by convection cooling within the air foil 12, film cooling on the surface of the blade, and the like (the details thereof will be described later).

As shown in FIG. 2A, in the blade tip 15 of the air foil 12 of the turbine blade 10, the squealer 23 is arranged to the starting end 14*a* of the trailing edge region 14 along the suction-surface-side blade wall 19 with the leading edge end 21 as a starting point, and the squealer is not provided to a trailing edge end 22 from the starting end 14*a*. That is, the portion of the upper surface 17*t* of the top plate 17 along the suction-surface-side blade wall 19 does not provide a squealer between the starting end 14*a* of the trailing edge region 14 and the trailing edge end 22, and is finished to the same height as the top plate 17 of the trailing edge region 14, and the upper surface 17*t* of the top plate 17 extends to the edge of the suction-surface-side blade wall 19. Additionally, the upper surface 17*t* of the top plate 17 along the pressurized-surface-side blade wall 20 from the leading edge end 21 to the trailing edge end 22 is not provided with a squealer.

FIG. 2B shows a cross-section (section A-A of FIG. 2A) in an erected direction of the blade shown in FIG. 2A. In order to prevent the damage by the high-temperature combustion gas, a heat-resistant coating 24 is applied on the whole upper surface 17*t* of the top plate 17. As described above, the squealer 23 arranged on the upper surface 17*t* of the top plate 17 is formed along the suction-surface-side blade wall 19 from the leading edge end 21 to the starting end 14*a* of the trailing edge region 14, and a squealer is not arranged from starting end 14*a* of the trailing edge region 14 to the trailing edge end 22. Instead, the upper surface along the suction-surface-side blade wall 19 from starting end 14*a* of the trailing edge region 14 to the trailing edge end 22 is finished so to be flush with the upper surface 17*t* of the top plate 17. Additionally, the heat-resistant coating 24 is applied on the upper surface 17*t* of the top plate 17, and the gap between the lower surface of the ring segment 60 and the upper surface 17*t* of the top plate 17 after the application of the heat-resistant coating is set to become as small as possible.

Additionally, it is important to suppress the height of the upper surface 17*t* of the top plate 17 after the application of the heat-resistant coating 24 of the trailing edge region 14 so as to be lower than a top surface 23*a* of the squealer 23 by a height difference H. Such a height difference is based on me following reasons.

The top surface 23*a* of the squealer 23 is the surface of a base material of the air foil 12 on which a heat-resistant coating is not applied and which is finished by machining. Meanwhile, as for the heat-resistant coating 24 laminated on the upper surface 17*t* of the top plate 17, the finishing precision equivalent to that of a machining surface is not obtained. That is, since the heat-resistant coating is not applied by plasma spraying etc., it is difficult to obtain a surface roughness equivalent to that of a machining surface, and a high-precision finished surface cannot be formed. Therefore, the upper surface 17*t* including the thickness of the heat-resistant coating of the top plate 17 is made lower than the top surface 23*a* of the squealer 23 by at least a predetermined value (height difference H) in consideration of the maximum variation range of the finished height of the heat-resistant coating. That is, even when the heat-resistant coating is formed with a greatest thickness, if the height difference between the upper surface 17*t* of the heat-resistant coating and the top surface 23*a* of the squealer 23 is maintained at a predetermined value (height difference H) or more, the upper surface 17*t* of the top plate 17 after the application of the heat-resistant coating will not become higher than the height of the top surface 23*a* of the squealer 23. Accordingly, there is no possibility that the top plate 17 of the trailing edge region 14 may contact the lower surface of the ring segment 60 even if the top surface 23*a* of the squealer 23 comes into contact with the lower surface of the ring segment 60 according to the operation conditions of a gas turbine. In addition, it would be better if the predetermined value is at least 0 (zero) mm or more.

In addition, applying heat-resistant coating on other blade surfaces, for example, the suction-surface-side blade wall 19, the pressurized-surface-side blade wall 20, and the side walls 23*d* of the squealer 23 is the same as that of the aforementioned conventional technique.

Next, the positional relationship between the squealer 23 and the cooling flow passage in the air foil 12 will be described with reference to FIG. 2B. Cooling flow passages 26 and 27 which receive a cooling medium CA via a cooling flow passage (not shown) bored in the blade root portion 16 from the rotor disc (not shown) side are arranged within the air foil 12. The cooling medium CA which cools the air foil 12 of the trailing edge region 14 is received from a cooling flow passage 26*a*, and is discharged into the combustion gas from the trailing edge end 22, and the cooling medium CA which cools the air foil 12 on the side of the leading edge is received by the cooling flow passage 27 from the blade root portion 16 side, and is discharged into the combustion gas from the leading edge end 21 side.

The cooling flow passage 26 (26*a*, 26*b*, 26*c*) forms a serpentine bend flow passage partitioned by a partition wall 29 which is formed within the air foil 12 and arranged in the radial direction of the blade. That is, the cooling medium CA is received from the blade root portion 16 side, and flows through the cooling flow passage 26*a* toward the blade tip 15, and like the arrow of the cooling medium CA shown in FIG. 2B, the cooling medium flows back at the blade tip 15, and flows through the cooling flow passage 26*b* in a downward direction (in a radial inward direction of the blade) toward the blade bottom 25, During this time, the cooling flow passage 26*a* and the cooling flow passage 26*b* are partitioned by a partition wall 29*b*. Moreover, the cooling medium CA flows back at the blade bottom 25, and flows through a final cooling flow passage 26*c* in an upward direction (in a radial outward direction of the blade) toward the blade tip 15. The space between the cooling flow passage 26*b* and the final cooling flow passage 26*c* is partitioned by a leading-edge-side partition wall 29*c*. Additionally, the space between the cooling flow passage 26*a* and the cooling flow passage 27 is completely partitioned by a partition wall 29*a*.

The cooling medium CA which flows through the final cooling flow passage 26*c* toward the blade tip 15 flows into a trailing edge cooling portion 30, cools the blade wall 18 on the side of the trailing edge, and is discharged into a combustion gas from the trailing edge end 22. The trailing edge cooling portion 30 shown in FIG. 2B adopts a multi-hole cooling method. A number of cooling holes 31 are bored in the trailing edge cooling portion 30 so as to pass through the trailing edge cooling portion 30 from the blade bottom 25 side to the blade tip 15. Each cooling hole 31 communicates with the final cooling flow passage 26*c* on the upstream, and opens into the combustion gas via the trailing edge end 22 on the downstream. While the cooling medium CA flows through the cooling holes 31, the convection cooling of the blade wall 18 of the trailing edge cooling portion 30 is performed.

Figure 5B:
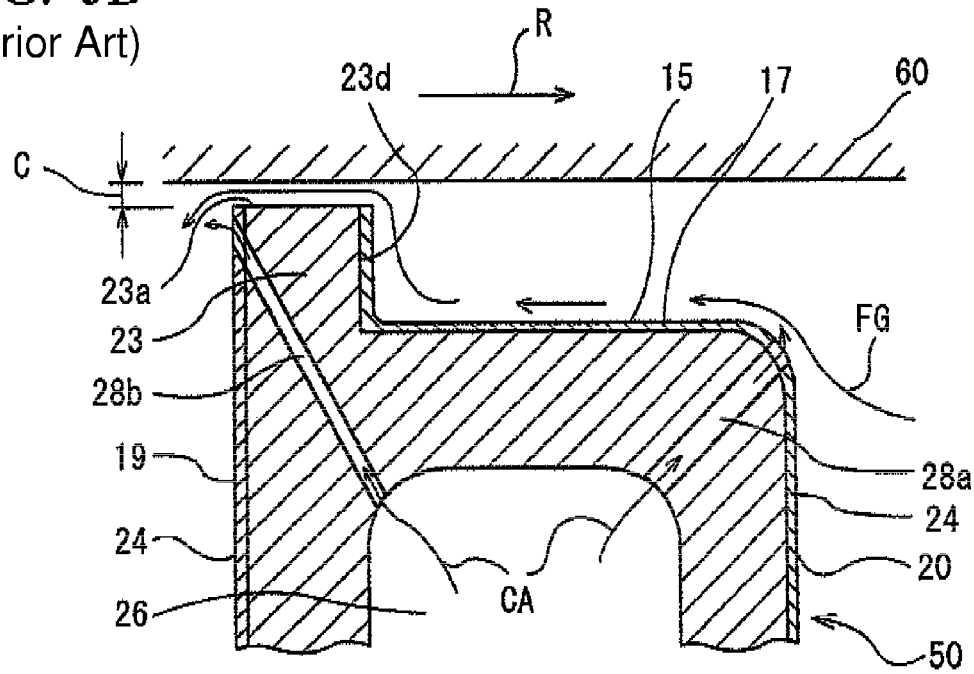
FIG. 5B (Prior Art)
FIG. 5B shows a schematic sectional view of the turbine blade of the conventional technique.

Additionally, the top plate 17 of the blade tip 15 is also cooled by the cooling medium CA which flows through the cooling flow passages 26 and 27. However, since the flow velocity of the combustion gas which flows over the squealer 23 is fast at the squealer 23 arranged on the upper surface 17*t* of the top plate 17 so as to protrude therefrom, a thermal load becomes higher than that of the top plate 17, which results in insufficient cooling. Therefore, a cooling flow passage 28, of which one end communicates with the cooling flow passages 26 and 27 and of which the other end communicates with the cooling holes 28*a* and 28*b* provided in the upper surface 17*t* of the top plate 17 and the top surface 23*a* of the squealer 23, is provided. By blowing off the cooling medium into the combustion gas, the convection cooling of the top plate 17 and the squealer 23 is performed to prevent these from being insufficiently cooled. In addition, the cooling holes 28*b* opened to the top surface 23*a* of the squealer 23, as shown in FIG. 5B, may be provided on the side of the suction-surface-side blade wall 19 in the vicinity of the boundary between the suction-surface-side blade wall 19 and the top surface 23*a* without being opened on the top surface 23*a*. If the cooling holes are opened at this position, when the top surface 23*a* comes into contact with the lower surface of the ring segment 60, there is no possibility that the cooling holes 28*b* are crushed, and a turbine can be stably operated.

As shown in FIGS. 2A and 2B, the cooling holes 28*b* provided along the suction-surface-side blade wall 19 are opened to the top surface 23*a* of the squealer 23 via the cooling flow passage 28 from the cooling flow passages 26 and 27 side, from the leading edge end 21 (squealer end 23*b*) to the squealer end 23*c*, and cooling holes 28*c* provided along the suction-surface-side blade wall 19 provided from the end 23*c* of the squealer 23 to the trailing edge end 22 are opened to the upper surface 17*t* of the top plate 17.

However, the cooling medium CA which flows through the inside of the air foil 12 exchanges heat with the inner wall of a cooling flow passage, and is turned into a hot cooling medium in the course of flowing through the cooling flow passages 26*a* and 26*b* and the final cooling flow passage 26*c* from the leading edge region 13 to the trailing edge region 14, and flows into the trailing edge cooling portion 30. Although the top plate 17 of the trailing edge region 14 is also cooled by the cooling medium which Sows through the trailing edge cooling portion 30, since the temperature of the cooling medium is high, cooling is apt to be insufficient.

Moreover, as shown in FIG. 2A, since the width of the blade is narrow in the trailing edge region 14, double-line cooling holes cannot be provided unlike the leading edge region 13, but only single-line cooling holes can be provided. That is, although double-line cooling holes 28*a* and 28*b* line are arranged on both sides of the suction-surface-side blade wall 19 and the pressurized-surface-side blade wall 20 of the leading edge region 13 from the leading edge end 21 on the upper surface 17*t* of the top plate 17 of the leading edge region 13, only single-line cooling holes 28*c* can be arranged from the starting end 14*a* of the trailing edge region 14 to the trailing edge end 22. In addition, the single-line cooling holes 28*c* of the trailing edge region 14 may be arranged along the suction-surface-side blade wall 19, may be arranged along the pressurized-surface-side blade wall 20, and may be arranged along an intermediate line between the suction-surface-side blade wall 19 and the pressurized-surface-side blade wall 20.

Since only single-line cooling holes 28*c* can be arranged in the trailing edge region 14, the trailing edge region is a region which is hard to cool as compared with the leading edge region 13, Since the squealer 23 has a high thermal load, the squealer is a portion which is especially hard to cool. Here, as for the single-line and double-line cooling holes, as seen in a cross-section vertical to a centerline (camber line) of the width of the blade which connects the trailing edge end 22 from the leading edge end 21 in the plan view of the blade shown in FIG. 2A, on either the top surface 23*a* of the squealer or the upper surface 17*t* of the top plate 17 from the suction-surface-side blade wall 19 to the pressurized-surface-side blade wall 20, a case where one line of cooling holes is arranged is referred to as the single-line cooling holes and a case where two or more lines of cooling holes are arranged is referred to as the double-line cooling holes.

In order to avoid the damage of the above squealer, the squealer 23 formed to the trailing edge region 14 along the suction-surface-side blade wall 19 with the leading edge end 21 as a starting point is cut at the starting end 14*a* of the trailing edge region 14 without extending to the trailing edge end 22. That is, the suction-surface-side end 23*c* of the squealer 23 is positioned at the position of the starting end 14*a* of the trailing edge region 14. The position of the starting end 14*a* coincides with the position of the partition wall 29*c* on the side of the leading edge in the plan view in the partition wall which forms the final cooling flow passage 26*c* in the air foil 12 (refer to FIG. 2B). That is, the squealer is not provided from the suction-surface-side end 23*c* of the squealer 23 to the trailing edge end 22, and finishing is performed so as to provide the same height as the top plate 17 of the trailing edge region 14.

Here, the meaning of the starting ends of the trailing edge region 14 and the trailing edge region 14 will be described with reference to the plan view and sectional view of the turbine blade shown in FIGS. 2A and 2B. As described above, the trailing edge region 14 is a region which is insufficiently cooled when compared with the leading edge region 13, and a place where the damage of the squealer tends to occur from the constraints of the installation space of the cooling holes, and the cooling air temperature included in the trailing edge cooling portion 30. That is, the trailing edge region 14 is a region including the above trailing edge cooling portion 30, and the final cooling flow passage 26*c* on the upstream thereof, and the leading edge region 13 is a region from the leading edge of the blade to the intermediate region excluding the trailing edge region 14 in FIG. 2A. The boundary 14*a* between the intermediate region and the trailing edge region 14, i.e., the starting end (position where the trailing edge region 14 starts) of the trailing edge region 14, coincides with the leading-edge-side partition wall 29*c* in the plan view of the partition wall which forms the final cooling flow passage 26*c* in the air foil 12. The planar position of the leading-edge-side partition wall 29*c* is considered to be the starting end 14*a* of the trailing edge region 14, and the region from the starting end 14*a* to the trailing edge end 22 is a region which is apt to be insufficiently cooled. Although it is desirable that the starting end 14*a* of the trailing edge region 14 be closer to the trailing edge end 22, the position of the starting end changes due to a thermal load applied to the blade. That is, although the starting end 14*a* of the trailing edge region is positioned at the position of the above leading-edge-side partition wall 29*c* if the thermal load to the blade is high, it is desirable to set the starting end to the position of the inlet port wall 30*a* of the trailing edge cooling portion 30 if the thermal load is small. Accordingly, the starting end 14*a* of the trailing edge region exists between the leading-edge-side partition wall 29*c* and the inlet port wall 30*a* of the trailing edge cooling portion 30, and may be changed within the region from the leading-edge-side partition wall 29*c* to an inlet port wall 30*a* of the trailing edge cooling portion 30 due to a thermal load applied to the blade.

According to the configuration of an invention shown in the first embodiment, since the squealer 23 is formed from the leading edge end 21 to the starting end 14*a* of the trailing edge region 14 along the suction-surface-side blade wall 19 in the peripheral direction of the blade, the region from the starting end 14*a* to the trailing edge end 22 is not provided with the squealer and is set to be flush with the top plate 17, and the heat-resistant coating 24 is not applied on the upper surface 17*t* of the top plate 17 where the squealer is not provided, the damage of the squealer can be prevented. Additionally, since the squealer 23 is provided from the leading edge end 21 to the starting end 14*a* of the trailing edge region 14, the gap flow of the combustion gas which flows over the blade tip 15 of the turbine blade can be made small.

Additionally, the heat-resistant coating 24 is applied on the upper surface 17*t* of the top plate 17 between the starting end 14*a* of the trailing edge region 14 in which the squealer 23 is not provided and the trailing edge end 22, whereby the gap between the lower surface of the ring segment and the upper surface of the top plate after application of the heat-resistant coating is set to be as small as possible.

Moreover, the magnitude of the gap flow which flows over the blade tip by the combustion gas which flows through an exhaust passage changes due to the differential pressure between the positive pressure (pressurized surface) applied to the pressurized-surface-side blade wall 20 and the suction (suction-surface) applied to the suction-surface-side blade wall 19. Since a differential pressure is markedly smaller in the trailing edge region than in the leading edge region, the influence which the gap flow of the trailing edge region has on the thermal efficiency of a gas turbine is small. Accordingly, according to this embodiments the damage of the squealer can be prevented, and a decrease in the thermal efficiency of a gas turbine can also be prevented.

Figure 3A:
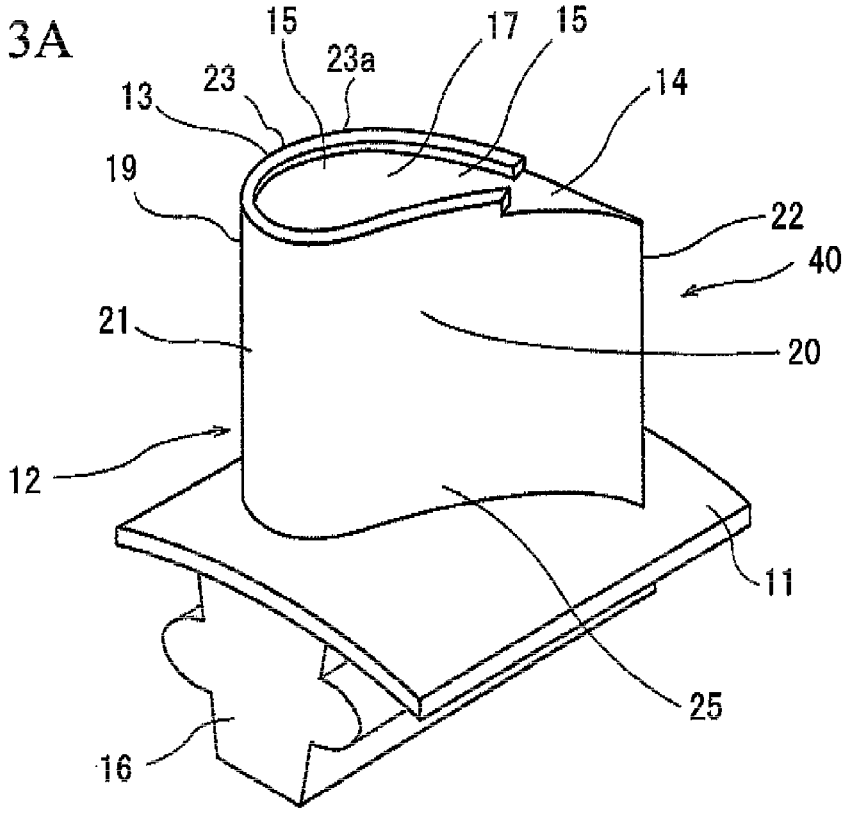
FIG. 3A shows a perspective view of a turbine blade according to a second embodiment.
Figure 3B:
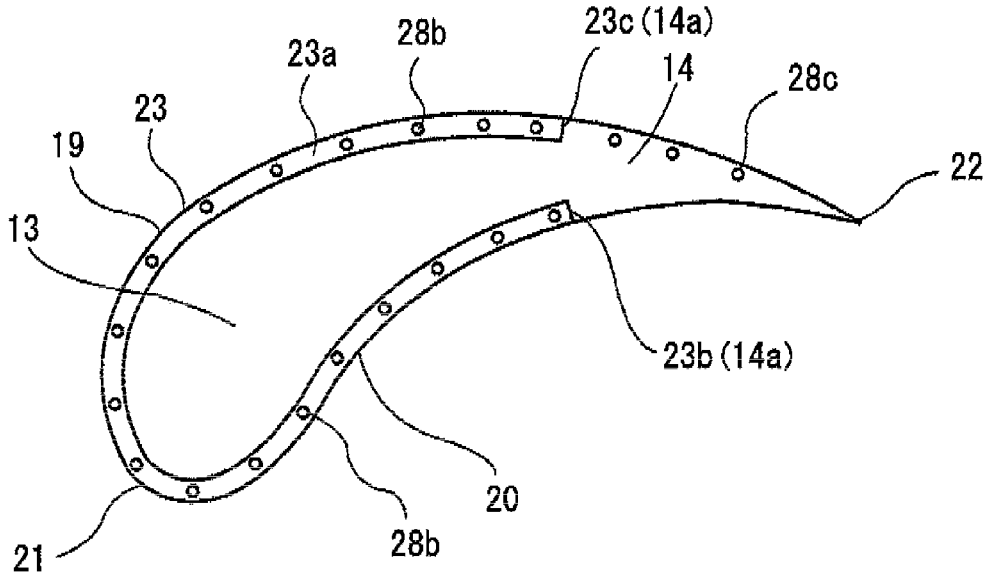
FIG. 3B shows a schematic plan view of the turbine blade according to the second embodiment.

A second embodiment of a turbine blade according to the present invention will be described with reference to FIGS. 3A and 3B. FIG. 3A shows a perspective view of the turbine blade according to the second embodiment, and FIG. 3B shows a schematic plan view. As shown in FIG. 3A, the squealer 23 provided on the upper surface 17*t* of the top plate 17 of the air foil 12 is formed from the starting end 14*a* of the trailing edge region 14 along the suction-surface-side blade wall 19 to the leading edge end 21, and is formed in a continuous belt shape from the leading edge end 21 along the pressurized-surface-side blade wall 20 to the starting end 14*a* of the trailing edge region 14. That is, both the pressurized-surface-side end 23*b* and the suction-surface-side end 23*c* of the squealer 23 are formed, at the starting end 14*a* of the trailing edge region 14. In addition, the cooling holes 28*b*, which the cooling medium CA is blown off from the cooling flow passages 26 and 27 within the air foil 12, are opened to the top surface 23*a* of the squealer 23 of this embodiment. Since other configurations are the same as those of the above-described second embodiment, the description of these configurations is omitted.

According to the second embodiment of the turbine blade related to the present invention, compared with a first embodiment, the squealer 23 arrives at the leading edge end 21 along the suction-surface-side blade wall 19 from the starting end 14*a* of the trailing edge region 14, is arranged to the starting end 14*a* of the trailing edge region 14 along the pressurized-surface-side blade wall 20, and the squealer is not provided from the starting end 14*a* of the trailing edge region 14 to the trailing edge end 22. Therefore, the damage of the squealer can be prevented. Additionally, since the squealer 23 is provided on both sides of the suction-surface-side blade wall 19 and the pressurized-surface-side blade wall 20, the gap flow of the combustion gas which flows over the squealer and flows into a downstream exhaust passage decreases, and a decrease in the thermal efficiency of a gas turbine can be further suppressed as compared with the first embodiment. Other operations and effects are the same as those of the first embodiment.

A third embodiment of a turbine blade according to the present invention will be described with reference to FIGS. 4A and 4B.

Figure 4A:
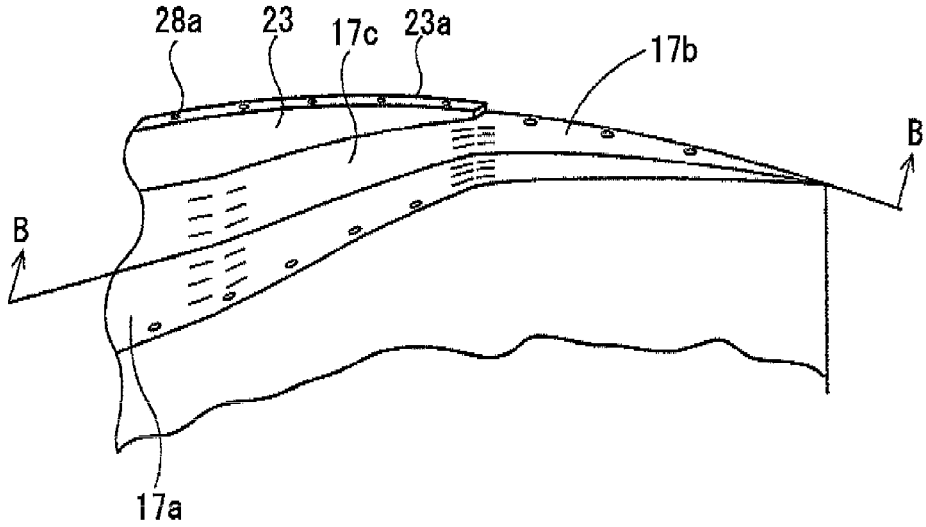
FIG. 4A shows a perspective view of a turbine blade according to a third embodiment.
Figure 4B:
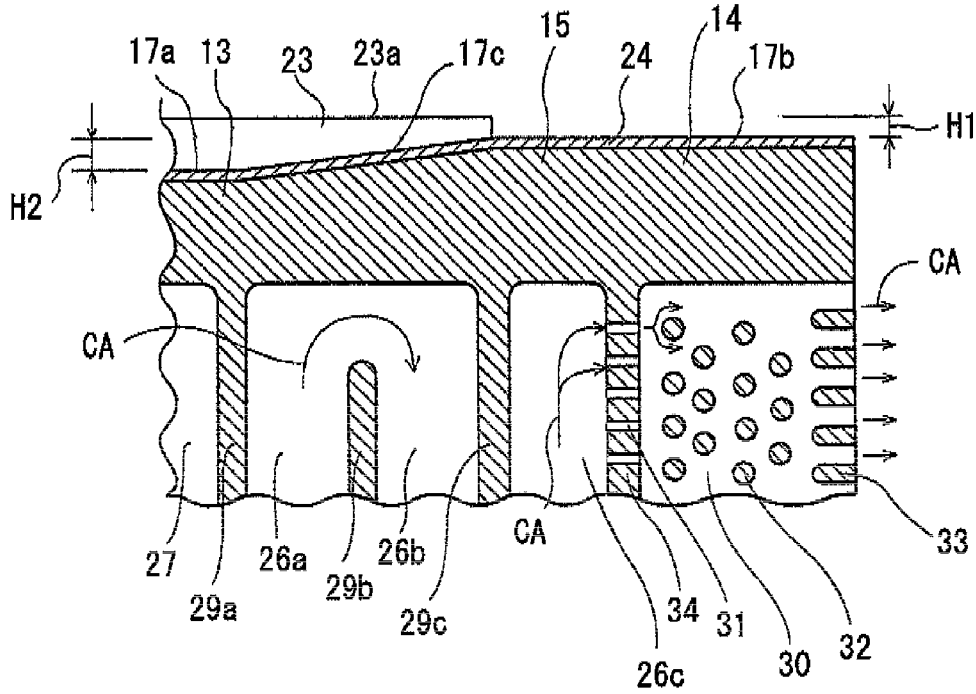
FIG. 4B shows a portion of a cross-section (section B-B of FIG. 4A) in an direction of the turbine blade according to the third embodiment.

As shown in FIGS. 4A and 4B, the first and second embodiments are the same in that the top plate 17 is formed by a smooth surface from the leading edge region 13 to the trailing edge region 14, and the blade tip 15 is blocked. Additionally, the first and second embodiments are the same in that the squealer 23 is provided along the suction-surface-side blade wall 19 and the pressurized-surface-side blade wall 20 from the leading edge region 13 to the trailing edge region 14, and the height of the upper surface 17*t* of the top plate 17 is set to be lower than the top surface 23*a* of the squealer 23 in order to reliably avoid any interference with the ring segment 60.

Meanwhile, a gas turbine may be operated in a state where the gap C between the lower surface of the ring segment 60 and the top surface 23*a* of the squealer 23 becomes small, and both surfaces come into contact with each other according to operation conditions of the gas turbine. Even in such a state, it is desirable to allow the operation of the gas turbine while the top surface 23*a* of the squealer is cut. However, when the contact state lasts for a long time, the difference (height difference H1) in height between the top surface 23*a* of the squealer and the upper surface 17*t* of the top plate 17 is set to be as small as possible in order to make the gap flow small. Therefore, a heavy, contact state may occur, where the upper surface 17*t* of the top plate 17 and the lower surface of the ring segment 60 come into contact with each other across their entire surfaces, and which results in an inability to operate.

Generally, like the first and second embodiments, the top plate 17 is set to have the same height from the leading edge region 13 to the trailing edge region 14, and the gap between the lower surface of the ring segment 60 and the upper surface 17*t* of the top plate 17 is set to be constant.

However, in order to avoid the occurrence of the above situation, the leading edge region 13 is formed to be lower than the trailing edge region 14, and the top plate 17 of this embodiment is formed to have a smooth upward gradient from the leading edge region 13 to the trailing edge region 14. That is, the leading edge region 13 of the top plate 17 is formed with a planar lower portion 17*a*, the trailing edge region 14 is formed with a planar higher portion 17*b*, and the higher portion 17*b* is set to be higher than the lower portion 17*a* radially outward from the blade. Additionally, the higher portion 17*b* of the trailing edge region 14 is set to be lower than the top surface 23*a* of the squealer 23. Moreover, the top plate 17 is formed with an inclined portion 17*c* which has a smooth upward gradient toward the higher portion 17*b* from the lower portion 17*a*. Additionally, since the surface connected to the higher portion 17*b* of the top plate 17 through the inclined portion 17*c* from the lower portion 17*a* of the top plate 17 is formed by a sloped smooth surface, a gap flow flows over this upper surface is not disturbed.

The heat-resistant coating 24 is applied on the upper surface 17*t* of the whole top plate 17. Although the heat-resistant coating 24 is also applied on the upper surface of the higher portion 17*b* of the trailing edge region 14, the height of the higher portion 17*b* after the application of the heat-resistant coating is suppressed so as to be lower than the height of the top surface 23*a* of the squealer 23 by the height difference H1. Additionally, the height of the higher portion 17*b* alter the application of the heat-resistant coating is set to be higher than the height of the lower portion 17*a* after the application of the heat-resistant coating of the leading edge region 13 by a height difference H2.

Here, the concept of the height difference H1 is the same as that of the first embodiment with respect to variations in the finished height of heat-resistant coating.

In addition, the trailing edge cooling portion 30 shown in FIG. 4B is an example in which a pin fin cooling method is adopted.

That is, a plurality of cooling holes 31 which supplies the cooling medium CA to the trailing edge cooling portion 30 arranged in the trailing edge region 14 is bored in the axial direction of the rotor from the blade root portion 16 to the blade tip 15 in the trailing-edge-side partition wall 34 which forms the final flow passage 26*c*, Additionally, the trailing edge cooling portion 30 has a region from the trailing-edge-side partition wall 34 to the trailing edge end 22. In the meantime, a number of pin fins 32 and a pedestal 33 are arranged from the blade root portion 16 to the blade tip 15. The trailing edge cooling portion 30 serves to receive the cooling medium CA from the final flow passage 26*c*, and to perform the convection cooling of the blade wall 18 of the trailing edge region 14. The cooling medium CA, which flows through the final flow passage 26*c* flows into the trailing edge cooling portion 30 via the cooling holes 31 bored in the trailing-edge-side partition wall 34, is convection-cooled at the pin fin 32, and is discharged into the combustion gas from the trailing edge end 22.

Even in the trailing edge cooling portion 30 in this embodiment, similarly to the first and second embodiments, there are constraints about the installation space of the cooling holes, and the cooling air temperature included in the trailing edge cooling portion 30. Accordingly, the configuration in which, in order to solve the problem of insufficient cooling in the trailing edge region, the squealer 23 is cut at the starting end 14*a* of the trailing edge region 14, and the squealer is not provided from the starting end 14*a* of the trailing edge region 14 to the trailing edge end 22, is the same as that of other embodiments.

In this embodiment, although the trailing edge cooling portion 30 has been described by the pin fin cooling method, the multi-hole cooling method shown in FIG. 2B of the first embodiment may be adopted. Additionally, the pin fin cooling method may be adopted in the trailing edge cooling portion 30 of the first embodiment shown in FIG. 23.

In this embodiment, the reason why the height difference of the top plate is provided as described above is in order to avoid a situation in which the ring segment 60 and the top surface 23*a* of the squealer 23 come into contact with each other according to the operational conditions of a gas turbine, the contact state endures, and the heavy contact stats occurs across the entire surfaces of the ring segment 60 and the upper surface 17*t* of the top plate 17. That is, the top surface 23*a* of the squealer 23 is the surface of a base material of the air foil 12 on which a heat-resistant coating is not applied and which is finished by machining. Meanwhile, as for the upper surface of the heat-resistant coating 24 laminated on the higher portion 17*b* of the top plate 17 of the trailing edge region 14, the finishing precision equivalent to that of a machining surface is not obtained. Accordingly, the upper surface 17*t* including the thickness of the heat-resistant coating of the top plate 17 is made lower than the top surface 23*a* of the squealer 23 by at least a predetermined value (height difference H1) in consideration of the maximum variation range of the finished height of the heat-resistant coating. Moreover, the upper surface of the higher portion 17*b* of the top plate 17 of the trailing edge region 14 is made higher than the upper surface of the lower portion 17*a* of the top plate 17 of the leading edge region 13 by a predetermined value (height difference H2).

As a result, such a heavy contact state that the lower surface of the ring segment 60 comes into contact with the entire surface of the blade tip 15 can be avoided, and the stable operation of a turbine becomes possible. In addition, applying heat-resistant coating on other blade surfaces, for example, the suction-surface-side blade wall 19, the pressurized-surface-side blade wall 20, and the side walls 23*d* of the squealer 23, is the same as that applying of heat resistant coating in the first embodiment and second embodiment.

In addition, although not shown in FIG. 4B, even in the third embodiment similarly to FIG. 2B of the first embodiment the cooling flow passage 28 for the cooling medium which is blown off to the top plate 17 and the squealer 23 from the cooling flow passages 26 and 27 within the air foil 12 is provided, and the cooling medium is discharged into the combustion gas from the cooling holes 28*a* and 28*c*.

By providing the configuration of this embodiment, the higher portion, lower portion, and an inclined portion in which a heat-resistant coating is applied on the top plate are formed by cutting out the squealer of the trailing edge region which is apt to be insufficiently cooled. Thus, the damage of the squealer is prevented and the loss of energy is reduced. Additionally, since the heavy contact with the top plate 17 of the blade tip 15 and the ring segment 60 can be avoided, the stable operation of a gas turbine is allowed.

In addition, the squealer 23 in the first embodiment is provided from the starting end 14*a* of the trailing edge region 14 along the suction-surface-side blade wall 19 to the leading edge end 21. However, even a case where the squealer is further extended to the middle of the leading edge region 13 along the pressurized-surface-side blade wall 20 from the leading edge end 21, that is, the squealer 23 does not reach the starting end 14*a* of the trailing edge region 14 along the pressurized-surface-side blade wall 20 from the leading edge end 21, but is arranged to the middle of the leading edge region 13, is the same in basic technical ideas as the first embodiment, and is included within the scope of the present invention.

According to the invention, since the damage of the squealer by a high-temperature combustion gas is prevented, and the loss of the combustion gas which flows over the turbine blade can be suppressed, a decrease in the thermal efficiency of a gas turbine can be prevented.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

The invention claimed is:

1. A turbine blade comprising:

an air foil including a plurality of cooling flow passages through which a cooling medium flows from a leading edge region to a trailing edge region;

a top plate which forms the apex of the air foil, has a heat-resistant coating applied on the upper surface thereof, and includes a plurality of cooling holes; and a squealer which protrudes radially outward from the blade from the top plate, and is formed so as to extend from a leading edge end to a starting end of the trailing edge region along a suction-surface-side blade wall in a peripheral direction of the blade, wherein a portion of the top plate between the starting end of the trailing edge region and the trailing edge end is not provided with the squealer, and the height of the top plate is set to be lower than the height of the top surface of the squealer by at least a predetermined value in consideration of variations in the finished height of the heat-resistant coating.

2. The turbine blade according to claim 1, wherein the height of the top plate of the leading edge region is formed so as to be lower than the height of the top plate of the trailing edge region, and an inclined portion which has an upward gradient toward the trailing edge region from the leading edge region is formed.

3. The turbine blade according to claim 2, wherein the plurality of cooling holes is arranged in a double line on the top surface of the squealer or the upper surface of the top plate in the leading edge region, and is arranged in a single line on the upper surface of the top plate in the trailing edge region.

4. The turbine blade according to claim 1, wherein the plurality of cooling holes is arranged in a double line on the top surface of the squealer or the upper surface of the top plate in the leading edge region, and is arranged in a single line on the upper surface of the top plate in the trailing edge region.

5. A turbine blade comprising:

an air foil including a plurality of cooling flow passages through which a cooling medium flows from a leading edge region to a trailing edge region;

a top plate which forms the apex of the air foil, has a heat-resistant coating applied on the upper surface thereof, and includes a plurality of cooling holes; and a squealer which protrudes radially outward of the blade from the top plate, is formed from a starting end of the trailing edge region along a suction-surface-side blade wall to a leading edge end in a peripheral direction of the blade, and is further formed so as to continuously extend from the leading edge end along a pressurized-surface-side blade wall to the starting end of the trailing edge region, wherein a portion of the top plate between the starting end of the trailing edge region and the trailing edge end is not provided with the squealer, and the height of the top plate is set to be lower than the height of the top surface of the squealer by at least a predetermined value in consideration of variations in the finished height of the heat-resistant coating.

6. The turbine blade according to claim 5, wherein the height of the top plate of the leading edge region is formed so as to be lower than the height of the top plate of the trailing edge region, and an inclined portion which has an upward gradient toward the trailing edge region from the leading edge region is formed.

7. The turbine blade according to claim 6, wherein the plurality of cooling holes is arranged in a double line on the top surface of the squealer or the upper surface of the top plate in the leading edge region, and is arranged in a single line on the upper surface of the top plate in the trailing edge region.

8. The turbine blade according to claim 5, wherein the plurality of cooling holes is arranged in a double line on the top surface of the squealer or the upper surface of the top plate in the leading edge region, and is arranged in a single line on the upper surface of the top plate in the trailing edge region.

* * * * *